US006099691A

United States Patent [19]

Clarke et al.

[11] Patent Number: 6,099,691

[45] Date of Patent: Aug. 8, 2000

[54] APPARATUS FOR CLEANING A PAPERMAKING MACHINE FORMING FABRIC

[75] Inventors: Robert L. Clarke; Jeffrey H. Pulkowski, both of Roscoe, Ill.

[73] Assignee: Beloit Technologies, Inc., Wilimington, Del.

[21] Appl. No.: 09/049,766

[22] Filed: Mar. 27, 1998

[51] Int. Cl.[7] ..... D21F 1/32

[52] U.S. Cl. ..... 162/279; 162/272; 162/275; 15/302; 15/309.1

[58] Field of Search ..... 162/272, 275, 162/279; 15/302, 309.1

[56] References Cited

U.S. PATENT DOCUMENTS

| | | | |
|---|---|---|---|
| 5,120,401 | 6/1992 | Kiviranta et al. | 162/275 |
| 5,381,580 | 1/1995 | Kotitschke et al. | 15/302 |
| 5,660,688 | 8/1997 | Kiviranta et al. | 162/279 |
| 5,783,044 | 7/1998 | Schneider et al. | 162/272 |
| 5,820,732 | 10/1998 | Gregersen et al. | 162/275 |

FOREIGN PATENT DOCUMENTS

| | | | |
|---|---|---|---|
| 751871 | 7/1980 | U.S.S.R. | 162/275 |

*Primary Examiner*—James Derrington
*Attorney, Agent, or Firm*—Lathrop & Clark LLP

[57] ABSTRACT

A method and apparatus for cleaning the forming fabric used on a papermaking machine includes a chamber surrounding a span of the forming fabric on either side thereof. A source of sub-atmospheric air pressure is connected to the chamber for removing water mist surrounding the fabric. Mounted within the chamber is a pair of high pressure-low volume water impingement showers in substantially opposed array for directing jets of relatively high pressure water against the forming fabric as the forming fabric passes through the chamber via slots on either end thereof. In a preferred embodiment, downstream of the pair of high pressure needle showers is a second shower apparatus comprising a relatively low pressure-high volume flooding water shower to direct a water spray against the inner side of the looped forming fabric to flood the interstices of the forming fabric with water to wash out pulp fibers therefrom. Downstream of the relatively lower pressure shower, and on the same side of the wire, is an air knife comprising a nozzle for directing a stream of compressed air against the forming fabric to blow water and pulp fibers entrained by the water from the interstices of the forming fabric and through the outer surface thereof and into a catch pan located in the chamber on the opposed side of the forming fabric. The high pressure-low volume opposed impingement showers thus operate in conjunction with the relatively low pressure-high volume shower and air knife within the enclosure to clean both sides of the forming fabric while simultaneously providing for removal of the water mist produced by the process (via the sub-atmospheric air pressure) to prevent fibers dislodged from the forming fabric from being deposited on the papermaking machinery, including the forming fabric itself, to thereby clean the forming fabric.

3 Claims, 2 Drawing Sheets

APPARATUS FOR CLEANING A PAPERMAKING MACHINE FORMING FABRIC

BACKGROUND OF THE INVENTION

1. Field of the Invention

This invention relates to the cleaning of a looped forming fabric which is used in a papermaking machine to receive an aqueous slurry of pulp fibers to permit water to be removed therethrough to form the nascent paper web on the outer surface of the looped forming fabric. More particularly, this invention relates to a method and apparatus for cleaning the outer surface and interstices of the looped forming fabric while simultaneously providing for collection of the water mist from spray nozzles used to dislodge pulp fibers from the surface and interstices of the forming fabric.

2. Description of the Prior Art

Prior apparatus and a method for cleaning the forming fabrics in papermaking machines often comprised the application of so-called flooding showers, which applied a relatively high volume-relatively low velocity water to the inner side of the looped forming fabric to loosen and remove contaminants, comprising mostly of paper pulp fibers and so-called fines, from the body, or interstices, of the fabric. Another fabric cleaning apparatus comprised of water showers applying a relatively high velocity-relatively low volume, stream of water to clean contaminants off the outer surface of the looped forming fabric. When these two methods or apparatus were used on the same papermaking machine, the relatively high volume and relatively low volume showers were used at different locations along the length of the forming wire.

Essentially, the relatively high pressure water shower operated by impinging the outer surface of the looped forming fabric to dislodge the wood pulp fibers from the surface of the forming fabric, while the relatively lower pressure water shower operated by impinging the inner surface of the looped forming fabric to flood the forming fabric with a relatively large volume of water which was urged outwardly through the outer surface of the forming fabric to thereby wash wood pulp fibers from the interstices of the forming fabric to thereby clean it.

Regardless of the method and apparatus utilized in prior forming fabric cleaning apparatus, shower mist, in the form of fine water spray, has been a significant problem on papermaking machines since such a mist always contains wood pulp fibers and so-called fines, which are small particles, which might include wood or clay. Mist contaminated with wood pulp fibers or fines is very undesirable because the mist settles on both the machinery itself as well as the paper web being formed. In either case, simply stated, the fibers and fines then deleteriously create a build-up which can become heavy enough to fall off the surface and onto the forming fabric or paper web, resulting in paper defects or sheet breaks during the papermaking process.

Solutions have been proposed to the misting problem. U.S. Pat. No. 5,381,580 teaches that pans, located on the side of the forming fabric opposite to a shower, can be brought into close proximity with the fabric so as to catch and collect water which passes through the fabric under the impetus of the shower. Such pans are assisted by the application of subatmospheric air pressure to more positively remove the water. If several cleaning showers are used, there is need for several individual pans, or at least one very large pan, which in either case requires considerable space.

In addition, the pan-opposite-to-the-shower solution proposed in the U.S. '580 patent only relates to flooding the interstices of the forming fabric to remove the pulp fibers and fines, but does nothing to resolve shower-side misting created when the water from a relatively high-pressure shower impinges the forming fabric.

Another solution utilizes a pair of opposed, relatively high pressure oscillating showers located on either side of the forming fabric. Each such shower is enclosed in a suction box which serves to capture both shower water coming through the fabric, driven by the opposed shower, and the mist created from the shower water impinging the fabric on the same side of the forming fabric. While this solution addresses the misting problem, and provides for a compact unit, the use of only relatively high pressure, so-called needle, showers limits cleaning primarily to the pulp fibers and fines on the surface of the traveling forming fabric.

SUMMARY OF THE INVENTION

This invention streamlines and optimizes the cleaning of the forming fabric by combining both relatively high pressure-low volume so-called needle water jets for directing a shower of water against the surface of the traveling forming fabric with relatively low pressure-high volume so-called flooding shower jets for washing cleansing water through the interstices of the forming fabric, which is typically woven, to remove wood pulp fibers and fines from within the forming fabric. All of this activity is done within an enclosed chamber to which a source of sub-atmospheric air pressure is applied to capture and remove the mist produced by both types of showers to thereby also remove the fibers and fines carried by the mist.

The relatively high-pressure shower nozzles are located on either side of the forming fabric, preferably in opposed array, but possibly slightly offset from one another in the direction of forming fabric travel. The relatively low pressure-high volume shower nozzle is located within the looped forming fabric to project the shower stream against the innerside of the traveling forming fabric to wash the fibers and fines outwardly from the outer surface of the forming fabric. It is, of course, this outer surface on which the aqueous slurry of fresh pulp fibers are deposited to initiate the paper forming process.

Operating in conjunction with the relatively low pressure-high volume water shower is a so-called air knife, which essentially comprises a slotted nozzle extending in the cross-machine direction through which super-atmospheric pressure air is projected against the inner surface of the looped forming fabric. This air knife is located downstream of the flood shower nozzle so as to provide the impetus for projecting the water carried on the forming fabric from the flood shower through the forming fabric and into the enclosed chamber. A deflector and a catch pan are provided within the enclosed chamber to deflect the spray mist projected through the forming fabric by the air knife and catch and retain the water from the spray for removal from the enclosed chamber.

Accordingly, it is an object of this invention to provide an improved forming fabric and water mist suppression and collection apparatus for use in a papermaking machine.

A feature of this invention is the provision of an enclosed chamber, which might comprise separate sub-chambers, for receiving, collecting and removing water spray contaminated by wood pulp fibers and/or fines from the forming fabric and environment of the papermaking machine.

Another feature of the invention is the use of relatively high pressure-low volume water needle showers disposed on either side of the forming fabric in conjunction with a relatively low pressure-high volume flood shower in conjunction with an air knife on the innerside of the forming fabric to clean the forming fabric from both within the forming fabric, on both of its surfaces and from in the interstices thereof.

These, and other objects, features and advantages of the invention will become readily apparent to those skilled in the art upon reading the description of the preferred embodiments in conjunction with the attached drawings.

DESCRIPTION OF THE PREFERRED EMBODIMENTS

In the description, alphabetical postscripts will be used to distinguish similar elements on the same side of the forming fabric, and prime marks will be used to distinguish similar elements on the other side of the forming fabric. Therefore, all of the various elements which comprise combinations of these designations, while they are shown on the drawings, will not be individually described.

Figure 1:
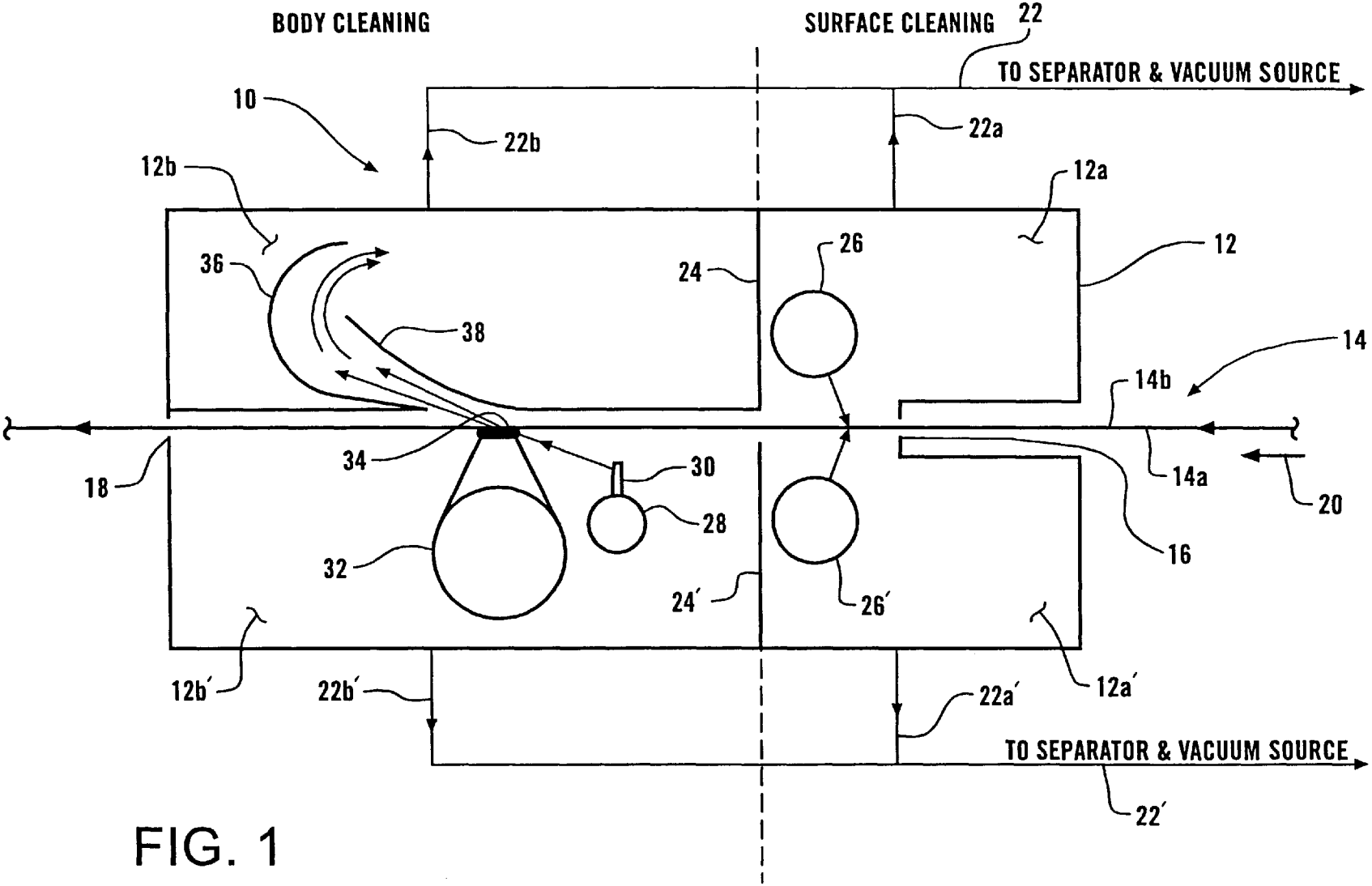
FIG. 1 is a side elevational view, in somewhat schematic format, of the apparatus of this invention.

Referring to FIG. 1, the forming fabric cleaning apparatus, generally designated by the number 10, comprises a chamber 12, which is shown disposed on either side of the looped forming fabric, generally designated as item 14, in a papermaking machine. The chamber 12 is essentially totally enclosed, except for narrow inlet and outlet slots 16 and 18 to permit the entry and exit of the forming fabric which is traveling in the direction of arrow 20. In this preferred embodiment, the chamber is divided into upstream and downstream sub-chambers 12*a* and 12*b*, respectively, and each of the sub-chambers is connected to a source of sub-atmospheric (i.e., vacuum) air pressure, such as is produced by a vacuum blower (not shown) via lines 22, 22'; 22*a*, 22*a*' and 22*b*, 22*b*' over the inner and outer sides 14*a*, 14*b*, respectively, of the forming fabric. In this embodiment, a partition 24, 24' separates the upstream and downstream sub-chambers over the outer and inner sides of the fabric, respectively. It is contemplated that no such partitions might be used in order to simplify the construction of the apparatus.

Within the upstream portion of chamber 12, or within the upstream sub-chamber 12*a*, 12*a*' within the inner side of the looped forming fabric and disposed over the outer side of the looped forming fabric, are a pair of impingement showers 26, 26'. These impingement showers are in substantially opposed array, but they could be offset in the direction of forming fabric travel.

These impingement showers are for directing relatively high pressure-relatively low volume of water pressure streams to impinge the surfaces of the forming fabric to dislodge any wood pup fibers, and/or fines, carried on the surfaces of the forming fabric.

Within the downstream portion of chamber 12, or within the downstream sub-chamber 12*b*', and within the inner side of the looped forming fabric, is a flood shower 28 having a nozzle 30 for directing a flooding shower of water against the inner surface of the forming fabric. Downstream, in the direction of forming fabric travel, of the flooding shower within the looped forming fabric is an air knife 32 which has a slotted nozzle 34 disposed in close proximity to the inner surface of the forming fabric, and which can be in contact with the forming fabric, for providing a stream of pressurized, or super-atmospheric pressure, air against the inner surface of the forming fabric.

Also within the downstream portion of the chamber 12, and disposed over the outer surface of the forming fabric, is a deflector 36 and a catch pan 38. The deflector is curved so as to direct a flow of air and mist upwardly and backwardly, relative to the direction of forming fabric travel, into the catch pan.

The chamber 12 has side walls, which are not shown for ease in viewing the apparatus, which side walls, in conjunction with the front, back and top walls, substantially enclose the chamber, except for the aforementioned entrance and exit slots 16, 18, so that a sub-atmospheric air pressure can be maintained within the chamber, as desired. Also not shown is a drain operatively connected to the catch pan 38 for removing water from the catch pan.

In operation, the traveling forming fabric enters the enclosed chamber via the inlet slot 16 and is subjected to the relatively high pressure-relatively low water volume impingement showers 26, 26*a*. The water directed by these impingement showers against the upper and lower surfaces of the forming fabric dislodge debris, in the form of wood pulp fibers and any fines, such as small fibers, and/or particles, such as clay used in coating material, from the surfaces of the forming fabric. This impinging action produces a mist within the chamber 12, or upstream sub-chambers 12*a*, 12*a*', and this mist is urged to be removed from the apparatus by means of the sub-atmospheric air pressure via lines 22; 22*a*, 22*b*; 22*a*', 22*b*' over the inner and outer sides of the forming fabric, respectively. As the forming fabric travels further downstream in chamber 12, or within the downstream sub-chamber 12*b*, the inner surface of the forming fabric is first subjected to the flood shower 28 which projects a relatively low pressure-relatively high volume of water (i.e., flooding volume) against the inner surface of the forming fabric. Downstream of the flood shower, the air knife 32 directs pressurized air against the inner surface of the forming fabric to project the water from the flood shower into the interstices of the forming fabric and to urge the water and the contaminants, such as wood pulp fibers and/or fines in the interstices, outwardly to the outer surface of the forming fabric and out of the forming fabric.

Water so urged outwardly impinges against the deflector and is collected in the pan from which it drains from the apparatus. Water and the wood pulp fibers and fines entrained in the water mist are urged from the chamber, or sub-chambers, via the vacuum lines 22; 22*a*, 22*a*'; 22*b*, 22*b*, as the case may be.

Accordingly, in this manner, the traveling forming fabric is cleaned thoroughly, both from the interstices forming the central portion of the forming fabric as well as the inner and outer surfaces of the forming fabric. This is done substantially simultaneously and all of the water, whether it is in the form of mist or condensed water in the catch pan, is removed from within the enclosed chamber such that the debris comprising wood pulp fiber and/or fines does not contaminant the structure of the papermaking machine, the forming fabric or the paper web product being produced.

Figure 2:
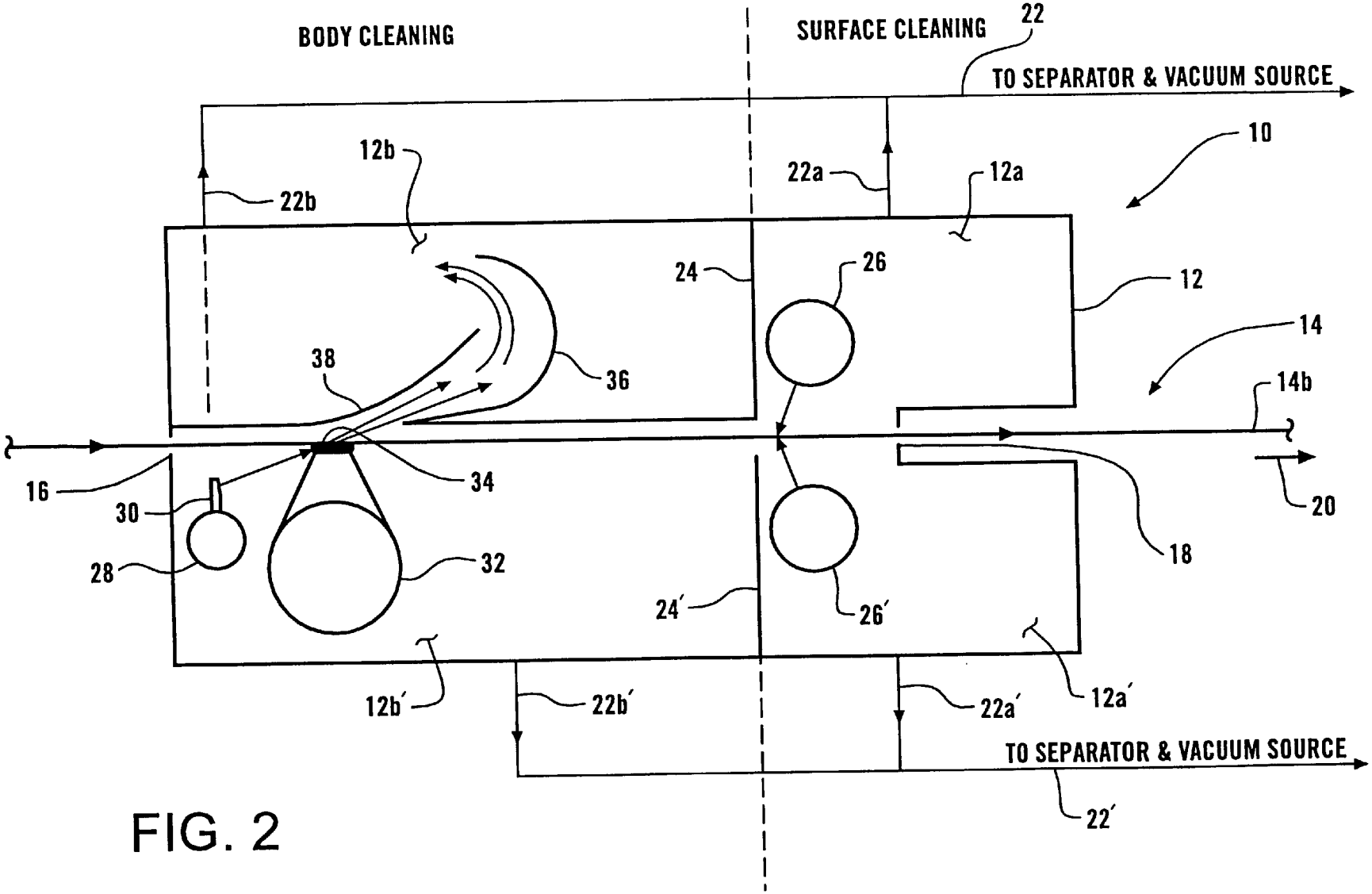
FIG. 2 is a side elevational view, in somewhat schematic format, showing the forming fabric traveling in the opposite direction to the direction of travel shown in the apparatus in FIG. 1.

In the embodiment shown in FIG. 2, the apparatus is similar to that shown in FIG. 1 with the primary distinction being that the direction of forming fabric travel is in the other direction than that shown in FIG. 1 as indicated by direction arrow 20. Therefore, the apparatus of the invention, including the impingement showers, flood shower, air knife, deflector and catch pan, shown in FIG. 2, and its operation, is also similar to that shown in FIG. 1, but in reverse order vis-a-vis the various showers and air knife.

Accordingly, an invention has been shown and described which meets the stated objectives, features and advantages, and those other features and advantages which are inherent in the operation of the invention. The claims, therefore, are limited only by the preferred embodiments, and equivalents of the various components, falling within the scope of the appended claims.

What is claimed is:

1. Apparatus for cleaning a looped, traveling forming fabric, having inner and outer surfaces, on a papermaking machine, including:

a chamber means having an inlet and outlet slots spaced apart in the direction of forming fabric travel, the chamber being substantially enclosed and so constructed and arranged as to permit sub-atmospheric air pressure to be maintained therein;

a pair of impingement showers disposed within the chamber means for directing a stream of relatively high pressure-low volume water against the inner and outer surfaces of the forming fabric for dislodging wood pulp fibers from the surfaces of the forming fabric with one impingement shower on each side of the forming fabric as the forming fabric passes through the chamber means;

a flooding shower disposed within the chamber means and within the looped forming fabric, the flooding shower downstream of the impingement showers and being so arranged as to flood the inner surface of the forming fabric with water toward wood pulp fibers outwardly through the outer surface of the forming fabric;

an air knife disposed within the chamber means and within the looped forming fabric downstream of the flooding shower for projecting a stream of super-atmospheric pressure air against the inner surface of the forming fabric to urge water from the flooding shower into, and through, the interstices of the forming fabric and out of the outer surface thereof;

collector means within the chamber means for receiving water carrying wood pulp fibers, which water has been urged out of the outer surface of the forming fabric by the impetus of the super-atmospheric pressurized air from the air knife; and air means operatively connected to the chamber means for establishing sub-atmospheric pressure air within the chamber for urging mist produced by the impingement showers, flooding shower and air knife out of the apparatus.

2. Apparatus for cleaning a looped, traveling forming fabric, as set forth in claim 1 wherein;

the chamber means comprises upstream and downstream sub-chambers which are formed by a partition within the chamber means.

3. Apparatus for cleaning a looped, traveling forming fabric, as set forth in claim 1, wherein:

the collector means comprises a deflector and a catch pan for deflecting mist produced by the air knife and collecting the resulting water for removal from the apparatus.

* * * * *